US011414316B2

(12) United States Patent
Miller

(10) Patent No.: US 11,414,316 B2
(45) Date of Patent: Aug. 16, 2022

(54) TRAINING HALTER

(71) Applicant: Mervin D. Miller, Orwell, OH (US)

(72) Inventor: Mervin D. Miller, Orwell, OH (US)

( * ) Notice: Subject to any disclaimer, the term of this patent is extended or adjusted under 35 U.S.C. 154(b) by 0 days.

(21) Appl. No.: 16/998,611

(22) Filed: Aug. 20, 2020

(65) Prior Publication Data

US 2021/0053813 A1 Feb. 25, 2021

Related U.S. Application Data

(60) Provisional application No. 62/922,627, filed on Aug. 20, 2019.

(51) Int. Cl.
*B68B 1/02* (2006.01)

(52) U.S. Cl.
CPC ..... *B68B 1/02* (2013.01)

(58) Field of Classification Search
CPC ..... B68B 1/02; B68B 1/04; B68B 1/00–14
See application file for complete search history.

(56) References Cited

U.S. PATENT DOCUMENTS 220,162 A * 9/1879 Manning ..... B68B 1/04 54/12
2,622,381 A * 12/1952 Mundell ..... B68B 1/02 54/24
3,458,971 A * 8/1969 Murray ..... B68B 1/04 54/6.1
3,949,538 A * 4/1976 Woodruff ..... B68B 1/02 54/24
4,472,925 A * 9/1984 Woodruff ..... B68B 1/02 54/24
4,722,171 A * 2/1988 Meroth ..... B68B 1/04 54/6.1
2004/0168413 A1* 9/2004 Rodgers ..... B68B 1/04 54/6.1
2013/0160409 A1* 6/2013 Crothers ..... B68B 1/02 54/24
2015/0259189 A1* 9/2015 Gipson ..... B68B 1/02 119/792
2017/0107096 A1* 4/2017 Tota ..... B68B 1/04

* cited by examiner

*Primary Examiner* — Monica L Barlow
*Assistant Examiner* — Madeline L Douglas
(74) *Attorney, Agent, or Firm* — Daniel M. Cohn; Howard M. Cohn

(57) ABSTRACT

A training halter encircling and conforming to a horse's head including a harness assembly encircling and conforming to the horse's head for applying direct pressure to regions of special acuity of the horse's head. A poll strap is formed with a first metal cable disposed within the poll strap. First and second cheek straps extend downward from a crown strap along the sides of the horse's head. A jaw strap is wrapped about and under the horse's neck. A nose band, a chin strap, and first and second throat straps are suspended so as to encircle the horse's nose and chin. The nose band formed with a second metal cable disposed within the nose band.

15 Claims, 4 Drawing Sheets

TRAINING HALTER

CROSS REFERENCE TO RELATED APPLICATIONS

This application claims the benefit of U.S. Provisional Patent Application No. 62/922,627 filed on Aug. 20, 2019, which is incorporated in its entirety by reference herein.

TECHNICAL FIELD OF THE INVENTION

The present invention relates to an improved training halter, and more particularly to a training halter for a horse that first exerts a quick pressure on the poll and the nose of a horse with the metal cables in the poll strap and the nose band and then releasing the pressure so that the horse feels good.

BACKGROUND OF THE INVENTION

Halters are used to enable animal owners, trainers and handlers to hold, control and lead their animals. Halters may be used with any animals, including horses, cattle or other livestock, zebras, dogs, etc. Improved control over the animal provides improved safety of the handler and others around the animal. Improved communication with the animal provides more efficient training, and therefore a quicker time to train the animal. Many different styles of halters have been utilized in the past for training procedures. Halters are generally bitless and make use of two loops; one extending around the nose of the animal and the other extending either around the neck or around from the poll to the chin groove and back.

Regardless of the configuration of traditional halters, halters are designed to allow the handlers to apply a downward pressure to the poll of the head, the neck, and/or the bridge of the nose. These traditional halters only provide this downward pressure which sends only a "stop" message to the animal. Traditional halters do not provide efficient directional messages. Also, since the straps of the halters are generally made of flat strips of leather or woven nylon, the applied downward force is generally a diffuse pressure applied across a fairly broad contact surface area at the poll or the nose.

SUMMARY OF THE INVENTION

According to an embodiment of the present invention, there is disclosed a training halter encircling and conforming to a horse's head. The training halter includes a harness assembly encircling and conforming to the horse's head for applying direct pressure to regions of special acuity of the horse's head. A poll strap is formed with a first metal cable disposed within the poll strap. First and second cheek straps extend downward from a crown strap along the sides of the horse's head. A jaw strap is wrapped about and under the horse's neck. A nose band, a chin strap, and first and second throat straps are suspended so as to encircle the horse's nose and chin. The nose band formed with a second metal cable disposed within the nose band.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
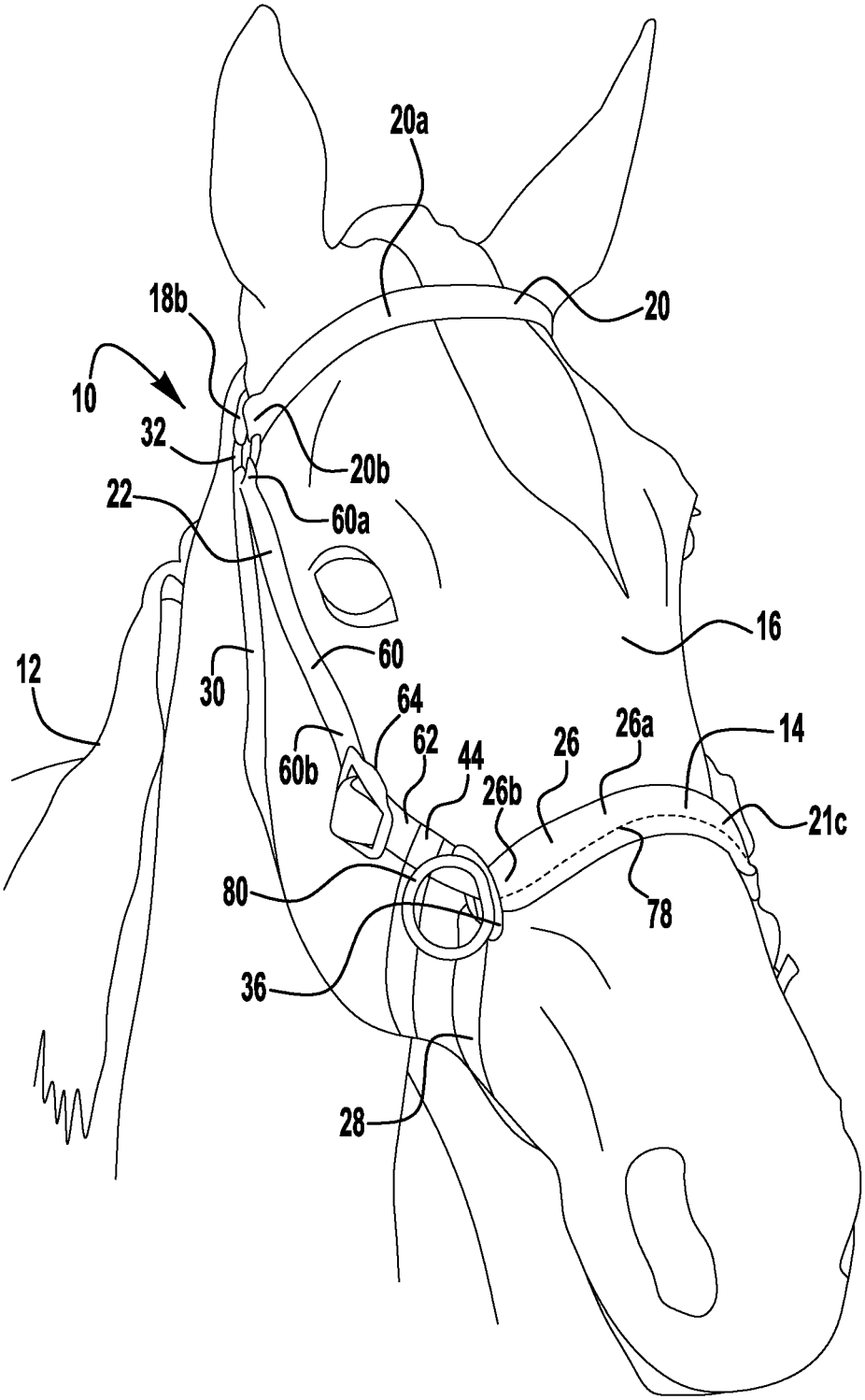
FIG. 1 is a three-dimensional, left side view of a horse wearing an improved training halter, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Managing a horse involves communication between the horse and the human handler, trainer, owner or rider. Horses are able to learn and obey commands communicated by the handler. This learning process takes time and can be hindered or facilitated by the manner in which the handler or rider communicates with the horse. Horses have a tendency to resist or push into steady pressure when spread across a wide surface area, for example a harness collar for pulling heavy loads. For example, if a handler is signaling the horse to come to a stop by applying steady pressure, the horse may ignore the command or try to resist if it is applied with a thick, wide collar.

The improved training halter 10 is designed to perform this communication between the horse and the handler. The improved training halter 10 functions by transferring physical motion made by the handler or rider into a form of physical contact with the horse's head, which is then transferred to the rest of the horse's body. The training halter 10 is worn on the horse's head, because the horse's head is particularly sensitive to contact, and the head is the best point of control for the whole animal.

The training halter 10 is designed to improve the efficiency in training procedures for animals by selectively applying pressure against various areas over selected nerves within the animal's head and nose. It acts as a calming way to train yearlings and 2-year old horses to trim and shoe without drugs and abuse. The training halter 10 is especially effective with unruly horses.

Figure 2:
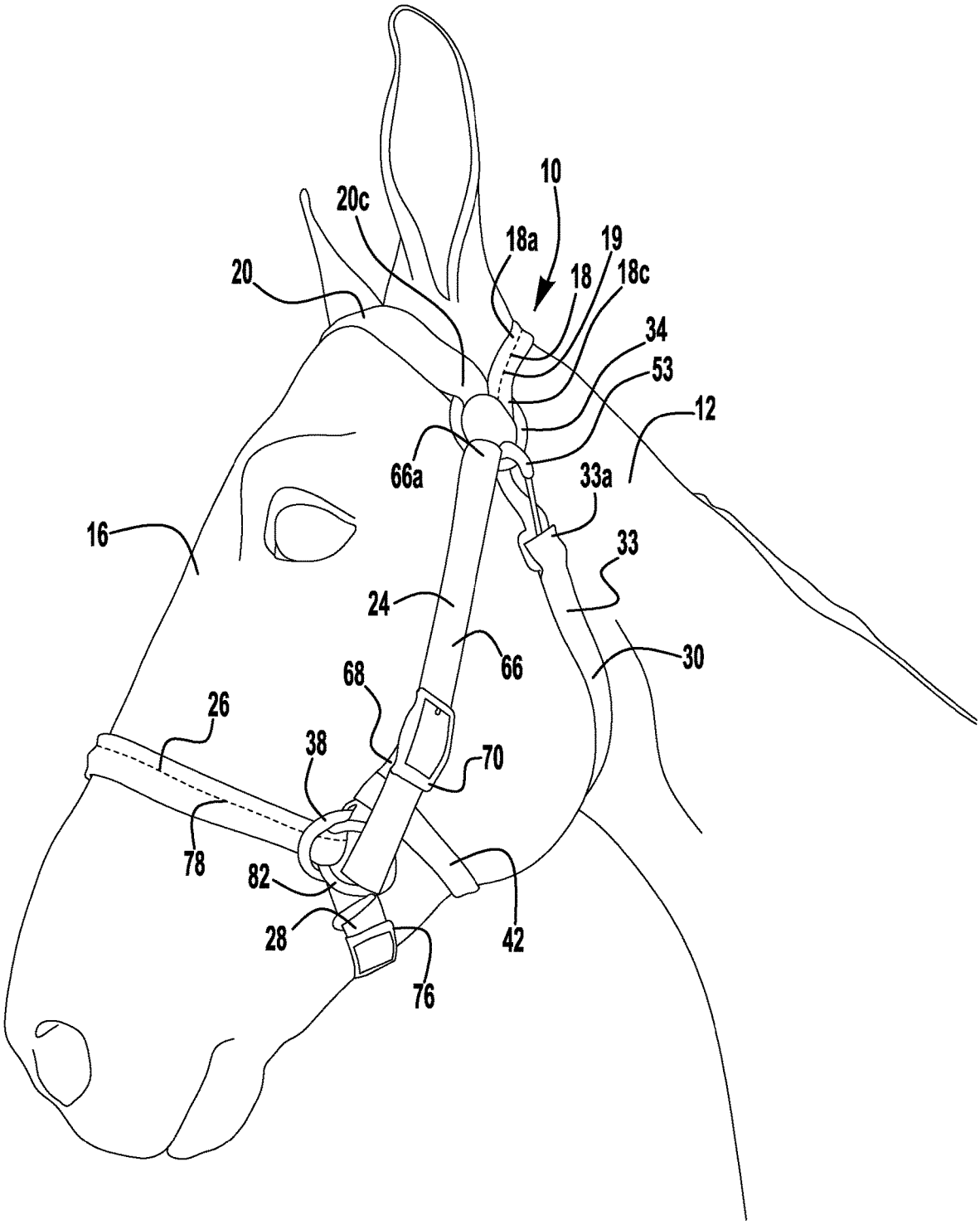
FIG. 2 is a three-dimensional, right side view of a horse wearing an improved training halter, in accordance with the present invention.

As shown in FIGS. 1 and 2, there is illustrated the improved training halter 10, specifically designed as a training device for horses 12. The improved training halter 10 is designed as a harness assembly 14 for attachment to the head 16 of the horse 12 and means for applying direct pressure to regions of special acuity such as the poll and the nose. The harness assembly 14 comprises an elongated poll strap 18, and includes a crown strap 20 and first and second cheek straps 22 and 24 extending downward from the crown strap along the sides of the head 16 of the horse 12. A jaw strap 30 is wrapped about and under the neck of the horse 12. A nose band 26, a chin strap 28, and first and second securing straps 42 and 44 are suspended so as to encircle the nose and chin of the horse 12. A plurality of rings, including first ring 32, second ring 34, third ring 36, and fourth ring 38 are anchored to the harness assembly 14 to connect the various straps, as discussed hereinafter.

The harness assembly 14 may be constructed out of leather, woven nylon, rope, cable or other flexible material. Further, the harness assembly 14 may also be padded for the animal's comfort. The exemplary version of the harness assembly 14 is constructed out of leather or nylon, though any suitable material may be used as would be apparent to one of ordinary skill in the art in view of the teachings herein.

Figure 3:
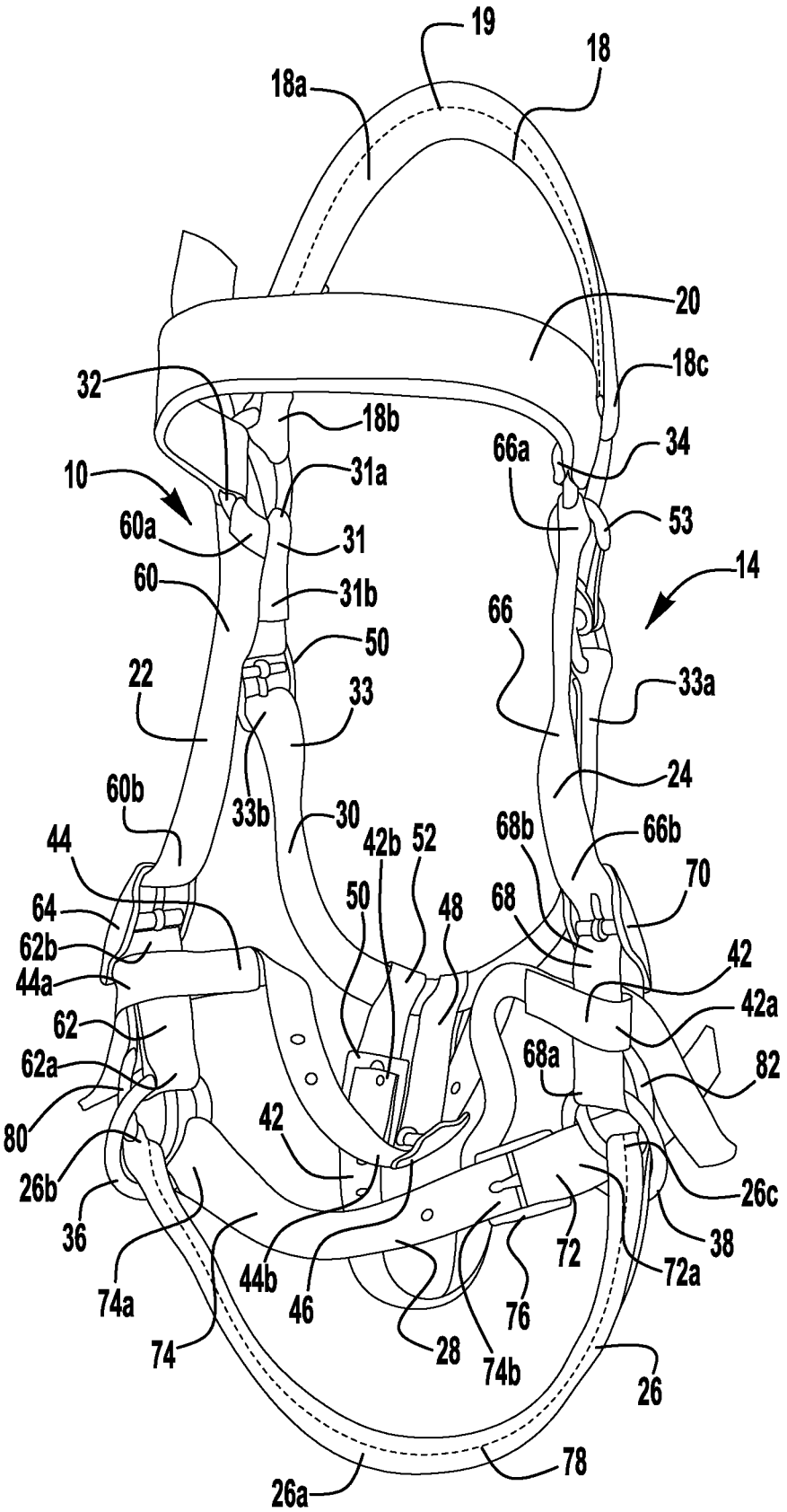
FIG. 3 is a top, three-dimensional view of the improved training halter, in accordance with the present invention.

The elongated poll strap 18 extends around and over the horse's 12 poll which is the area immediately behind the ears. The underlying bones of the poll are the top of the skull bone and the cervical bones of the neck. In this area are many nerve endings and acupressure points. As seen in FIG. 3, the elongated poll strap 18 is formed of a strip 18*a* of material, having first and second ends 18*b* and 18*c* and folded over to form a pocket extending the length of the strap therein. The poll strap 18 is formed with a metal cable 19 disposed within the pocket of the strap and secured at one end 18*c* to second ring 34 and at an opposite end 18*b* to first ring 32. The metal cable 19 is designed to exert pressure on the nerves within the poll of the horse 12. The cable may be any desired and appropriate dimensions, with an exemplary dimension of 3/32" in diameter.

The first and second ends 18*b* and 18*c* are elements of the strap 18 that attach to the first and second rings, 32 and 34, respectively. As illustrated, first and second ends 18*b* and 18*c* are stitched about the first and second rings, 32 and 34, respectively, to be permanently affixed thereto.

The crown strap 20 extends around and over the crown of the head of the horse 12. As seen in FIG. 3, the crown strap 20 is formed of a second strip 20*a* of material, having first and second ends 20*b* and 20*c*. The first and second ends 20*b* and 20*c* are elements of the crown strap 20 that attach to the first and second rings, 32 and 34, respectively. As illustrated, first and second ends 20*b* and 20*c* are stitched about the first and second rings, 32 and 34, respectively, to be permanently affixed thereto.

As seen in FIGS. 1-4, a jaw strap 30 is formed of two separate portions 31 and 33. First portion 31 of the jaw strap 30 is a length of third material which is attached at a first end 31*a* to the first ring 32, and has a buckle 50 attached at a second end 31*b*. The second portion 33 of the jaw strap 30 is a length of material which is attached at a first end 33*a*, preferably with a clip 53 to the second ring 34. The connection between the second end 33*b* to the buckle 50 allows for adjustments of the jaw strap to properly fit the harness assembly 14 to the particular horse on which the harness is being attached.

Figure 4:
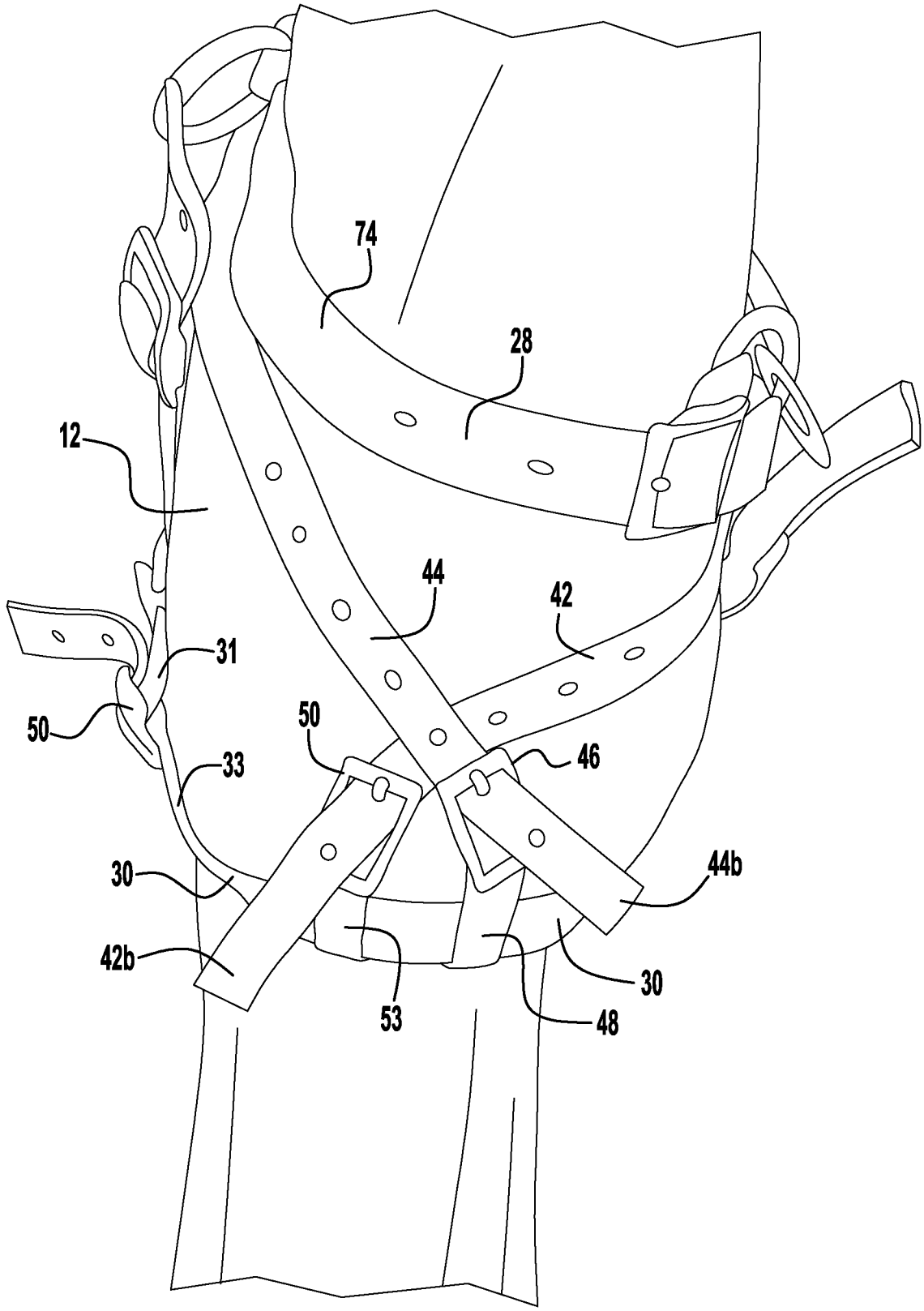
FIG. 4 is a front, three-dimensional view of underside of the head of a horse wearing the improved training halter, in accordance with the present invention.

Further, as seen in FIGS. 3 and 4, first and second underside straps 48 and 52 are slidably attached to the second portion 33 of the jaw strap 30. The first underside strap 48 has a second buckle 46 attached thereto, and the second underside strap 52 has a third buckle 47 attached thereto.

A first cheek strap 22 is formed of two separate portions 60 and 62. First portion 60 of the first cheek strap 22 is a length of material which is attached at a first end 60*a* to the first ring 32 and a second end 60*b* adapted to be fastened with a clasp to a fourth buckle 64. The second portion 62 of the first cheek strap 22 is a length of material which is attached at a first end 62*a* to the third ring 36, and at a second end 62*b* to the fourth buckle 64. The connection between the second end 60*b* to the buckle 64 allows for adjustments to the fit of the harness assembly 14.

The second cheek strap 24 is formed of two separate portions 66 and 68. First portion 66 of the second cheek strap 24 is a length of material which is attached at a first end 66*a* to the second ring 34, and a second end 66*b* connects to a fifth buckle 70. The second portion 68 of the second cheek strap 24 is a length of material which is attached at a first end 68*a* to the fourth ring 38. The second end 66*b* of the first portion 66 connects to the fifth buckle 70 to form the second cheek strap 24. The connection between the second end 66*b* to the fifth buckle 70 allows for adjustments to the fit of the harness assembly 14.

As seen in FIGS. 3 and 4, further slidably attached to the second portion 62 of the first cheek strap 22 is a first securing strap 44, having a first end 44*a* movably secured to the second portion 62, and a second end 44*b* connecting to the second buckle 46 attached to the strap 48. Further slidably attached to the second portion 68 of the second cheek strap 24 is second securing strap 42 having a first end 42*a* slidably secured to the second portion 68 and a second end 42*b* connecting to the first buckle 50 of the strap 52.

As seen in FIGS. 3 and 4, the chin strap 28 is formed of two separate portions 72 and 74. First portion 72 of the chin strap 28 is a length of material which is attached at a first end 72*a* to the fourth ring 38. A buckle 76 is attached at a second end 72*b*. The second portion 74 of the chin strap 28 is a length of material which is attached at a first end 74*a* to the third ring 36 is connected to the sixth buckle 76 at a second end 74*b* to form the chin strap 28. The connection between the second end 74*b* to the buckle 76 allows for adjustments to the fit of the harness assembly 14.

The nose band 26 which extends over the nose of the horse 12 that includes the area of the mouth, nostrils, chin, lips, and front of the nose. The muzzle is very mobile and sensitive. In this area are many nerve endings and acupressure points. As seen in FIGS. 1-3, the nose band 26 is formed of a strip 26*a* of material, having first and second ends 26*b* and 26*c* and folded over to form a pocket extending the length of the nose band therein. The nose band 26 is formed with a metal cable 78 disposed within the pocket of the strap and secured at one end 26*b* to a fifth ring 80 and at an opposite end 26*c* to a sixth ring 82. The metal cable 78 is designed to exert pressure on the nerves within the nose of the horse 12. The cable may be any desired and appropriate dimensions, with an exemplary dimension of 3/32" in diameter.

The fifth attachment ring 80 is disposed on a side of the third ring 36, and the sixth attachment ring 82 extends on a side of the fourth ring 38 to secure the nose band 26 between the third and fourth rings.

When the harness is secured to a horse and a rope is attached to either ring 36 or 38, when the rope is pulled, the harness contracts so that the metal cable 19 in the poll strap 18 exerts pressure on the nerves within the poll of the horse 12 and the metal cable 78 in the nose band 26 simultaneously exert pressure on the nerves within the nose of the horse. The horse feels a quick shock but then when the rope is released it immediately dissipates and the horse feels relaxed. The result is that the training harness 14 is used in training horses, the horse is controlled by first exerting a quick pressure on the poll and the nose with the metal cables in the poll strap and the nose band and then releasing the pressure so that the horse feels good.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A training halter encircling and conforming to a horse's head, comprising:

a harness assembly encircling and conforming to the horse's head, neck and ears for applying direct pressure to regions of special acuity of the horse's head;

a poll strap formed of a first strip of material, having first and second ends and folded over to form a first pocket extending the length of the poll strap;

the poll strap formed with a first metal cable disposed within the pocket of the poll strap extending the length of the poll strap for exerting pressure on the nerves within the poll of the horse;

a crown strap;

first and second cheek straps extending downward from the crown strap along the sides of the horse's head;

a jaw strap wrapped about and under the horse's neck;

a nose band, a chin strap suspended from the nose band, and first and second securing straps suspended from the first and second cheek straps so as to encircle the horse's nose and chin;

the nose band formed of a second strip of material having first and second ends and folded over to form a second pocket within the noseband extending the length of the nose band;

a second metal cable disposed within the second pocket of the nose band and extending the length of the nose band; and third and fourth attachment rings attached to first and second ends, respectively, of the nose band; and whereby when a rope attached to one of the third and fourth attachment rings is pulled, the harness contracts so that the first metal cable in the poll strap exerts pressure on nerves within the poll of the horse and the second metal cable in the nose band simultaneously exerts pressure on nerves within the nose of the horse so that the pressure in the poll and nose of the horse immediately dissipates when the rope is released.

2. The improved training halter of claim 1, wherein the first metal cable within the poll strap is secured at a first end to a first ring and at second end to a second ring.

3. The improved training halter of claim 2, wherein the first and second ends of the poll strap are stitched about the first and second rings, respectively, to be permanently affixed thereto.

4. The improved training halter of claim 3, wherein the crown strap is formed of a second strip of material, having first and second ends that attach to the first and second rings, respectively.

5. The improved training halter of claim 4, wherein the first and second ends of the crown strap are stitched about the first and second rings, respectively, to be permanently affixed thereto.

6. The improved training halter of claim 5, wherein the jaw strap is formed of first and second separate portions, wherein;

the first portion of the jaw strap is a third strip of material which is attached at a first end to the first ring and is attached at a second end to a first buckle; and the second portion of the jaw strap is a fourth strip of material which is attached at a first end to the second ring and is attached at a second end to the first buckle.

7. The improved training halter of claim 6, wherein first and second underside straps are slidably attached to the second portion of the jaw strap.

8. The improved training halter of claim 6, wherein the first underside strap has a second buckle attached thereto, and the second underside strap has a third buckle attached thereto.

9. The improved training halter of claim 8, wherein the first cheek strap is formed of first and second separate first cheek strap portions, wherein;

the first portion of the first cheek strap portion is a length of material having a first end attached to the first ring and a second end adapted to be fastened with a clasp to a fourth buckle; and the second portion of the first cheek strap portion is a length of material which is attached at a first end to a third ring and a second end adapted to be fastened with a clasp to the fourth buckle.

10. The improved training halter of claim 9, wherein the second cheek strap is formed of first and second separate second cheek strap portions, wherein;

the first portion of the second cheek strap portions is a length of material which is attached at a first end to the second ring and a second end adapted to be fastened with a clasp to a fifth buckle; and the second portion of the second cheek strap portions is a length of material which is attached at a first end to a fourth ring, and at a second end adapted to be fastened with a clasp to the fifth buckle.

11. The improved training halter of claim 10, wherein slidably attached to the second portion of the first cheek strap is a first securing strap, having a first end movably secured to the second portion of the first cheek strap is the first securing strap, and a second end connecting to the second buckle attached to the first underside strap.

12. The improved training halter of claim 11, wherein slidably attached to the second portion of the second cheek strap is a second securing strap, having a first end slidably secured to the second portion, and a second end connecting to the third buckle attached to the second underside strap.

13. The improved training halter of claim 12, wherein the chin strap is formed of first and second chin strap portions, wherein;

the first chin strap portion is a length of material which is attached at a first end to the fourth ring, and having a sixth buckle attached at a second end; and the second chin strap portion is a length of material which is attached at a first end to the third ring and is connected to the sixth buckle at a second end.

14. The improved training halter of claim 13, wherein the nose band is secured at one end to a fifth ring, which is disposed outside of the third ring, and at an opposite end to a sixth ring which extends outward from the fourth ring to secure the nose band between to the third and fourth rings.

15. The improved training halter of claim 14, wherein the second metal cable within the nose band is secured at a first end to the fifth ring and at second end to the sixth ring.

* * * * *